United States Patent [19]

Seiz et al.

[11] 4,351,417

[45] Sep. 28, 1982

[54] SPEED RETARDER

[75] Inventors: Frederick G. Seiz, Telford; Carl G. Seiz, Hatfield, both of Pa.

[73] Assignee: Variable Control Systems, Inc., Telford, Pa.

[21] Appl. No.: 207,622

[22] Filed: Nov. 17, 1980

[51] Int. Cl.[3] ..... B66B 5/16

[52] U.S. Cl. ..... 187/81; 182/231; 188/65.1; 254/391

[58] Field of Search ..... 187/81, 89, 38, 20, 187/22; 182/5, 231; 254/267, 391, 378, 402, 405; 188/188, 189, 65.1, 72.7; 24/130, 136 R, 136 L

[56] References Cited

U.S. PATENT DOCUMENTS

| | | | |
|---|---|---|---|
| 392,999 | 11/1888 | Esson et al. | 182/231 |
| 1,116,434 | 11/1914 | Johansson | 254/391 |
| 2,262,328 | 11/1941 | McKissick | 254/405 |
| 2,623,732 | 12/1952 | Morgan | 254/391 |
| 2,680,593 | 6/1954 | McIntyre | 254/151 |
| 3,120,043 | 2/1964 | Henley | 188/65.1 |
| 3,807,696 | 4/1974 | Brda | 254/154 |
| 4,003,550 | 1/1977 | Brodin | 254/151 |
| 4,173,332 | 11/1979 | DuLondel | 254/160 |
| 4,234,069 | 11/1980 | Seiz et al. | 193/35 |

*Primary Examiner*—Robert J. Spar
*Assistant Examiner*—Kenneth Noland
*Attorney, Agent, or Firm*—Howson and Howson

[57] ABSTRACT

A speed retarder used in combination with a flexible member such as rope, cable, or chain to control the speed of the flexible member relative to the speed retarder. The speed retarder is particularly suited for use in applications where it is desirable to lower a load at a controlled rate of speed from a higher elevation to a lower elevation. Such applications include fire escape devices and safety backup devices for elevators. One specific embodiment of the speed retarder comprises a frame having an axle on which is mounted a pair of rollers each having a tapered surface around which a flexible member is trained and retained between the surfaces by means of guides. The wheels are mounted on the axle for combined rotary and outward sliding motion into brake pads carried by the frame outboard of the wheels. Tension on the flexible member combined with movement thereof causes the wheels to be forced outwardly into pressure engagement with the brake pads, thereby creating friction on the outsides of the wheels to slow the same and thus to retard the speed of the flexible member relative to the frame.

22 Claims, 6 Drawing Figures

SPEED RETARDER

FIELD OF THE INVENTION

The present invention relates to speed control devices, and more particularly, the present invention relates to devices for use in combination with flexible members to control the speed of the flexible member relative to the device. The present invention finds particular utility in fire escape devices and in fail safe devices for elevators.

BACKGROUND OF THE INVENTION

In U.S. Pat. No. 4,234,069 issued on Nov. 18, 1980 to the assignee of the present application, there is disclosed apparatus for controlling the speed of vehicles on trackways. In one specific embodiment, the apparatus comprises a pair of wheels mounted on an axle for combined rotary and axial motion in a frame which carries brake pads outboard of the wheels. A pair of these assemblies may be mounted to the underside of a pallet for riding on one or more inclined rails mounted in a storage rack. The assemblies control the speed of the pallet on the rail by causing the load on the pallet to urge the wheels outwardly into engagement with the brake pads for creating friction between the wheels and the frame and thereby slowing the speed of the vehicle as it advances down the rails.

While the aforementioned patented invention operates entirely satisfactorily for its intended purpose to control the speed of a vehicle on an inclined trackway, there is a demand for a speed control device which can be used in conjunction with highly flexible members, such as cables, ropes, chains, etc. to lower loads vertically or at steep inclines at controlled rates of speed from a higher level to a lower level. For instance, one application for the invention includes fire escape devices where it is necessary for a person to be able to lower himself from a high level to a lower level at a controlled safe rate of speed. Another application for the invention is in providing a controlled rate of descent for a platform in an elevator in the event the main drive for the elevator should fail. In all of these applications, there is a need for a device which provides accurate speed control, which is highly reliable in operation, and which has a minimum of moving parts so as to be capable of being manufactured economically by high speed mass production techniques.

OBJECTS OF THE INVENTION

With the foregoing in mind, a primary object of the present invention is to provide a novel device for use in combination with a flexible member to enable a load to be lowered at a controlled rate of speed from a higher level to a lower level.

It is another object of the present invention to provide a unique safety device which provides an accurate speed control for a flexible member used therewith, which is highly reliable in operation, and which is inexpensive to manufacture.

A further object of the present invention is to provide a line speed retarder which has particular application as a fire escape device.

As a still further object, the present invention provides a safety device which finds particular utility in conjunction with elevators to provide a controlled rate of descent of the elevator platform in the event of a malfunction of its primary raising and lowering mechanism.

SUMMARY OF THE INVENTION

As a more specific object, the present invention provides a mechanism for use in combination with a flexible member, such as a rope, cable, chain, or the like to control the velocity of the flexible member relative to the mechanism or vice versa. To this end, the mechanism comprises a frame having an axle on which is rotatably mounted a pair of wheels at least one of which is also slidable axially on the axle. At least the slidable wheel, but preferably both wheels, have tapered confronting surfaces providing a peripheral gap which is adapted to receive the flexible member. Brake pads are carried on the frame outboard of the slidable wheel and are adapted to slow the rotational speed of the wheels when the flexible member advances under tension and is forced downwardly into the gap between the wheels. Guide means in the frame cooperates to maintain the flexible member engaged with the wheels through a predetermined arcuate extent to limit relative motion between the flexible member and the wheels. Thus, when the frame is mounted at a high level and a load is applied to the flexible member at that level, the load descends to the lower level at a controlled rate of speed. Alternatively, if the flexible member is mounted stationary between higher and lower levels, the frame is capable of moving along the flexible member at a controlled rate of speed. Accordingly, it should be apparent that the device of the present invention can be utilized in a variety of applications.

BRIEF DESCRIPTION OF THE DRAWINGS

The foregoing and other objects, features, and advantages of the present invention should become apparent from the following description when taken in conjunction with the accompanying drawings, in which.

DESCRIPTION OF PREFERRED EMBODIMENTS

Figure 1:
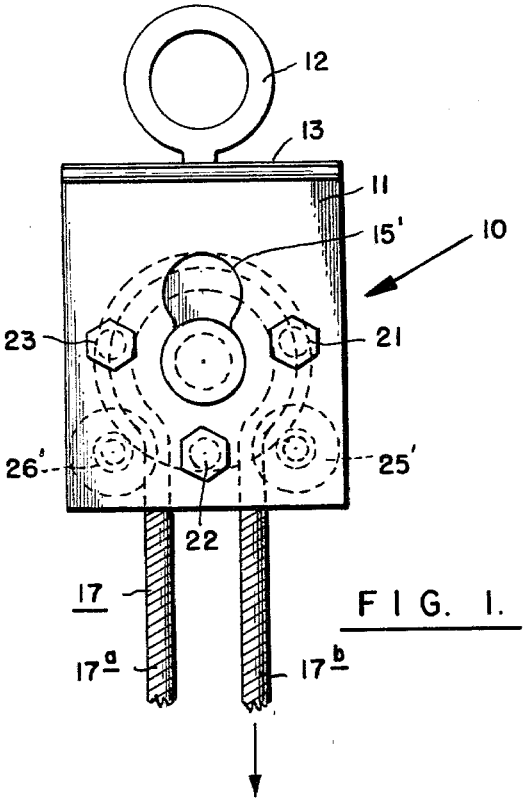
FIG. 1 is a side elevation view of a mechanism embodying the present invention.

Referring now to the drawings, FIG. 1 illustrates a line speed retarder 10 which embodies the present invention. The speed retarder 10 is designed to cooperate with a flexible member or line, such as a rope, cable, or the like, to retard the speed of the line through the speed retarder 10. Thus, the speed retarder 10 is particularly suited for use as a fire escape device to enable a person to lower himself safely at a controlled rate of speed from great heights.

Figure 2:
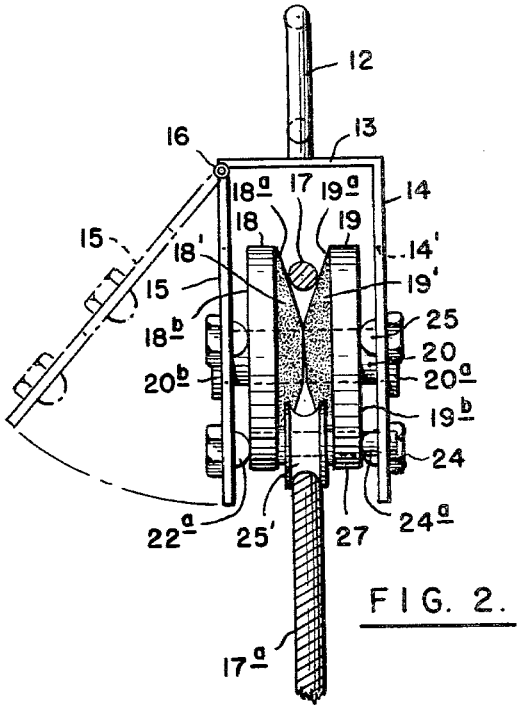
FIG. 2 is an end elevation view of the mechanism illustrated in FIG. 1.

To this end, the speed retarder 10 comprises a frame 11 mounting an eye or hanger 12 on its top web 13 to enable the frame 11 to be secured stationary, such as, for instance, to a building. As best seen in FIG. 2, the frame 11 has a pair of legs 14 and 15 depending in parallel relation from the top web 13 to define an inverted U-shaped frame structure. Preferably, the left-hand leg 15 is secured along its upper edge to the top web 13 by means of a hinge 16 affording inward and outward swinging motion of the leg 15.

A pair of control wheels 18 and 19 are mounted in the frame 11 to rotate about a horizontal axis provided by an axle 20. Preferably, the axle 20 has enlarged heads 20*a* and 20*b* at opposite ends, and the legs 14 and 15 of the frame 11 are provided with slots 14′ and 15′ affording upward and downward sliding motion of the axle 20. The slot 15′ in left-hand leg 15 preferably has a keyhole-shape with an enlargement at its upper end. The enlargement is sized sufficiently large as to allow the leg 15 to be swung outwardly about the hinge 16 in the manner illustrated in FIG. 2 when the axle 20 is slid upwardly until the axle head 20*a* registers therewith. With the left-hand leg 15 opened, the line 17 can be installed between the control wheels 18 and 19. After installation, the leg 15 can be swung downward and the axle 20 pushed downwardly in the slots 14′ and 15′ to its lower-limit position. This locks the legs 14 and 15 in operating relation as illustrated in FIG. 2.

Preferably, both control wheels 18 and 19 are of like construction and both are mounted for combined rotary and axial motion on the axle 20. Each wheel, such as the right-hand wheel 19, has a tapered inboard surface 19*a* and an outboard braking surface 19*b* which confronts the inside of the frame leg 14. The left-hand control wheel 18 has similar surfaces 18*a* and 18*b*, respectively. The inboard surfaces 18*a* and 19*a* cooperate to define therebetween a V-shaped peripheral groove or gap which receives a predetermined length of the line 17. Preferably, the inside tapered surfaces 18*a* and 19*a* are provided with serrations or roughened areas 18′ and 19′, respectively, in order to augment the friction between the line 17 and the wheels 18 and 19 and thereby to limit relative sliding motion therebetween.

The desired speed control function is achieved by causing the outboard surfaces 18*b* and 19*b* of the wheels 18 and 19 to be urged outwardly under pressure into engagement with brake-pad means carried by the frame outboard of the control wheels 18 and 19. To this end, the brake-pad means comprises a plurality of brake-pads, such as the pads 21, 22 and 23, spaced apart about the axle 20 in the left-hand leg 15 of the frame 11. A similar arrangement of brake pads 24, 25 are provided in the right-hand leg 14 of the frame 11. Preferably, each brake-pad, such as the brake-pads 22 and 24, have heads 22*a* and 24*a*, respectively which are located so as to engage the outboard surfaces 18*b* and 19*b*, respectively of the control wheels 18 and 19. The brake-pads are secured to the legs 15 and 14 in a manner which enables them to resist substantial outward pressures applied thereto by means of the control wheels 18 and 19. The brake-pads may be fabricated as bolts molded of a synthetic plastic material, such as nylon or Zytel, and having their heads located on the insides of the legs 14 and 15.

In order to maintain the line 17 properly engaged with the tapered control surfaces 18*a* and 19*a* of the control wheels 18 and 19, guide means is provided in the frame 11. In the embodiment illustrated in FIGS. 1 and 2, the guide means comprises a pair of rollers 25′ and 26′ mounted in proximity with the control wheels 18 and 19. Each roller, such as the roller 25′, is mounted to the right-hand frame leg 14 by means of a stub shaft 27. Each roller, such as the roller 25′, also has a concave periphery and is so located as to span a portion of the gap between the control wheels surfaces 18*a* and 19*a*. The guide rollers 25′ and 26′ are both disposed to one side of the axle 20 on the side opposite the hanger 12 and sufficiently close to one another as to cause the line 17 to extend through an arc of at least 180°, and preferably 270°, around the wheels 18 and 19 in the manner illustrated. The guide rollers 25′ and 26′ insure that the line 17 is maintained in the gap between the wheels 18 and 19 and is not thrown outwardly thereof by centrifugal force due to too rapid a rotation of the control wheels 18 and 19.

In operation, downward tension in the direction indicated by the arrow in FIG. 1 on the right-hand end 17*b* of the line 17, causes a portion of the line 17 engaged between the inboard surfaces 18*a* and 19*a* of the control wheels 18 and 19 to lodge firmly therebetween as the wheels 18 and 19 rotate. This movement of the line 17 inwardly along the inboard surfaces 18*a* and 19*a* causes the control wheels 18 and 19 to be forced axially outward as they rotate. Axial movement of the control wheels 18 and 19 causes their outer surfaces 18*b* and 19*b*, respectively, to engage the brake-pads 21–25 with pressure to create friction acting in a direction counter to the rotational direction of the wheels 18 and 19. This friction operates to retard the rotational speed of the wheels 18 and 19, and because of the frictional engagement of the line 17 with the inboard wheel surfaces 18*a* and 19*a*, the speed of the line 17 in the downward direction is retarded. As a result, a load carried by the line 17*b* will descend downwardly at a constant controlled rate of speed so long as a new length of line 17*a* is fed upwardly into the device 10. Should it be desirable to stop the downward descent of a load, this could be accomplished simply by applying additional tension to the left-hand end 17*a* of the line 17 and thereby causing the line 17 to lodge more deeply between the control wheels 18 and 19 to further drive the wheels apart and increase the friction applied to the drive wheels 18 and 19 and hence to the line 17.

Substantial counter pressures are applied by the control wheels 18 and 19 to the line 17. In order to accommodate these pressures, it is preferable for the line 17 to be fabricated of steel strands. If, however, the line 17 is fabricated as a rope of synthetic materials such as nylon, it is preferable for there to be provided between the control surfaces 18*a* and 19*a* a ring to prevent the line 17 from deforming and too deeply engaging in the gap. Alternately, the surfaces 18*a* and 19*a* could be provided with a diminished taper in the direction of the axle to form the gap with more of a U-shape than the V-shape illustrated.

To use the device 10 as a fire escape device, a person need simply fasten the eye 12 of the frame 11 to some firm object of a building at an upper level. One end of the line 17, such as the right-hand end 17*b*, can then be fastened about the person's body, such as under the arms, and the other end 17*a* allowed to dangle freely, such as along the outside of the building. The person can then lower himself simply by allowing this body weight to cause the line 17 to be lodged between the control wheels 18 and 19 in the manner described. Since heavier bodies will cause the line 17 to lodge more deeply between the control wheels 18 and 19, it should be apparent that the device 10 automatically compensates for different body weights. Thus, heavier bodies create greater friction and hence a greater braking action. As a result, the device 10 operates to provide a controlled rate of descent largely independent of the weight of the person using the device.

Figure 3:
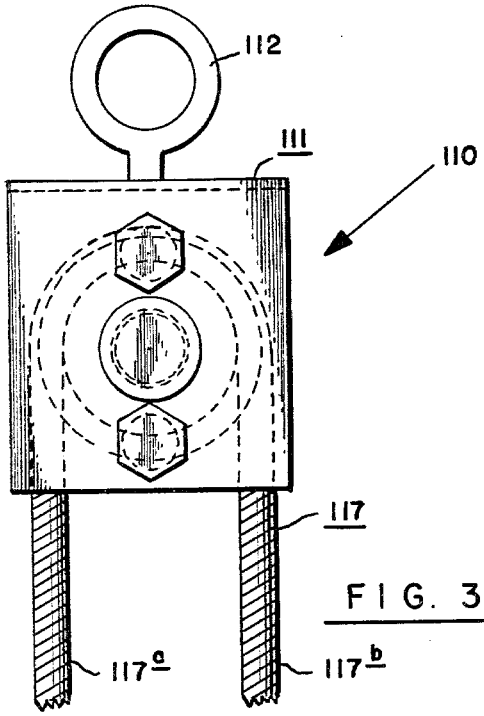
FIG. 3 is a view similar to FIG. 1 but illustrating a modified embodiment of the present invention.
Figure 4:
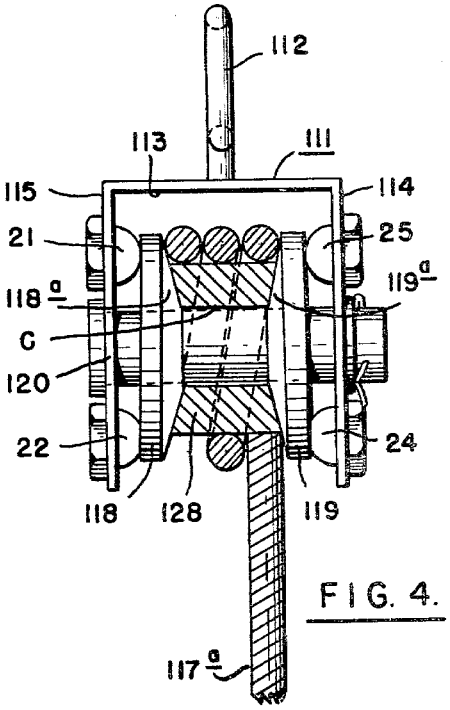
FIG. 4 is a partially-sectioned end elevational view of the embodiment illustrated in FIG. 3.

A modified embodiment of the present invention is illustrated in FIGS. 3 and 4. As seen therein, the speed retarder 110 comprises a frame 111 with a top web 113 and a pair of depending legs 114 and 115 bent downwardly therefrom. An eye 112 projects upwardly from the top web 113. An axle 120 extends horizontally across the legs 114 and 115 and mounts a pair of control wheels 118 and 119 for combined rotary and axial motion on the axle 120 in the manner described heretofore with respect to the previous embodiment. A pair of brake-pads 21 and 22 are mounted at diametrical locations in the left-hand leg 115, and a like pair of brake-pads 24 and 25 are similarly mounted in the right-hand leg 114 of the frame 111.

The control wheels 118 and 119 are like in structure to the control wheels 18 and 19 described in the previous embodiment, and the control wheels 118 and 119 operate in a similar manner to cooperate with the brake-pads 21–25 to provide a braking action when urged outwardly from one another.

In the embodiment of FIGS. 1 and 2, the line 17 directly engages the wheels 118 and 119 to urge them outward into pressure engagement with the brake-pads 21–25. In this embodiment, however, such motion is effected by a collar 128 interposed between the inboard surfaces 118*a* and 119*a* of the control wheels 118 and 119, respectively. The collar 128 has a bore which is slightly larger than the outside diameter of the axle 120 so as to fit loosely on the axle 120 with a clearance C. The clearance C is important, because, as will be described, it is necessary for the upper portion of the collar 128 to move downwardly a slight distance in order to urge the control wheels 118 and 119 outwardly. In order to prevent slippage between the collar 128 and the control wheels 118 and 119 the ends of the collar are preferably roughened or serrated, as are the tapered inboard surfaces of the control wheels 118 and 119, to provide the desired frictional interengagement. Preferably, the cable 117 is wrapped at least one, and preferably two or more, times about the collar 128 such as in the manner illustrated.

With this structure, downward tension on the end 117*b* of the cable 117 causes the collar 128 to rotate and to be urged downwardly toward the axle 120. This, in turn, causes the control wheels 118 and 119 to be forced outwardly on the axle 120 as they rotate, thereby causing the outboard surfaces of the control wheels 118 and 119 to engage the brake-pads 21–25 in much the same manner as the wheels 18 and 19 in the embodiment of FIGS. 1 and 2. This action causes friction to be applied to the wheels 118 and 119 to retard their rotational velocity, and this friction operates via the tight engagement of the collar 128 with the wheels 118 and 119, and the engagement of the cable 117 about the collar 128, to cause the downward speed of the cable 117 to be slowed.

While the illustrated collar 128 is fabricated of steel and is rigid, it may be fabricated of a compressible material such as a hard rubber. With such material, the clearance C between the bore of the collar 128 and the axle 120 may be eliminated, since, with this material, radial compression due to the constriction of the cable 117 causes the collar 128 to expand axially endwise, thereby forcing the control wheels 118 and 119 outwardly into operative engagement with the brake-pads 21–25. This material has the additional advantage of providing good frictional interengagement between the cable 117 and the collar 128 and between the collar 128 and the wheels 118 and 119.

Figure 5:
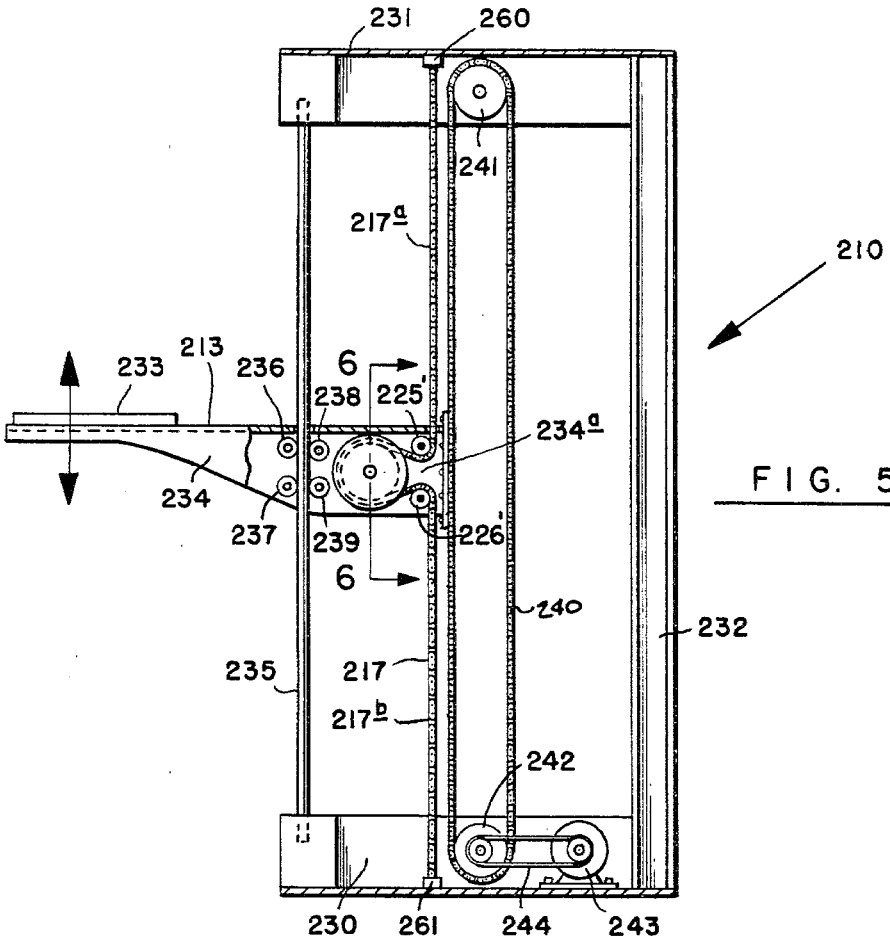
FIG. 5 is an elevational view with portions broken away of another embodiment of the present invention illustrating the speed retarder in combination with an elevator to provide a failsafe function.
Figure 6:
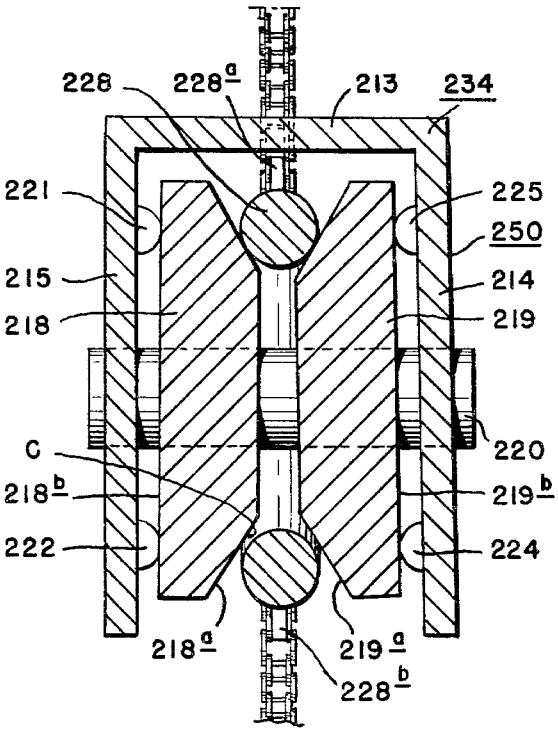
FIG. 6 is an enlarged sectional view taken on line 6—6 of FIG. 5.

A still further embodiment of the present invention is illustrated in FIGS. 5 and 6. In this embodiment, the invention is utilized to provide a fail-safe function for apparatus wherein loads are moved vertically, such as elevators, fork-lift trucks, order pick-up trucks used in automated warehouses, etc. There are, of course, many additional applications where the invention may be utilized. These are merely listed by way of example, and not by way of limitation.

Referring now to FIG. 5, a portion of an order pick-up truck 210 of the type used to retrieve goods from racks in warehouses is illustrated, it being understood that various nonimportant details of the truck have been omitted from the drawings for purposes of clarity. The order pick-up truck 210 comprises a base 230 which underlies a support member 231 connected to the base by means of one or more posts 232. A load support platform 233 is mounted for vertical movement in the direction indicated by the arrows in FIG. 5 to a frame 234 which is guided vertically between the base 230 and the upper member 231. The frame 234 is guided by a guide rod 235 which cooperates with a series of guide rollers 236–239 rotatably mounted in the frame 234 and engaging opposite sides of guide rod 235 to restrain torquing of the frame 234 about a horizontal axis when moving up and down with a load on the platform 233.

In order to raise and lower the load platform 233, the inner or rear end 234*a* of the frame is connected to a drive chain 240 which is trained at its upper end around a sprocket 241 and trained at its lower end about a sprocket 242. The chain 240 is driven by means of a motor 243, either electric or hydraulic, connected to the lower sprocket 242 by a drive belt, chain, etc. 244. Thus, movement of the chain 240 vertically between the base 230 and the overlying structural member 231 causes the platform 233 to be raised or lowered, as desired. Control means, not shown, is provided for actuating the motor 243 to drive the platform in the desired direction.

In event the drive chain 240 should break almost anywhere along its length when the platform 233 is in elevated position, it should be apparent that the platform 233 would fall rapidly and would, when brought suddenly to a stop at the base 230, damage whatever was carried on the platform 233. This undesirable consequence of chain breakage is eliminated in the present invention by providing in the frame 234 a speed retarder 250 having certain common characteristics with the speed retarders discussed heretofore. The speed retarder 250 limits the downward speed of the platform 233 in the event of drive chain breakage while at the same time not interfering with the normal upward and downward motion of the platform 233.

To this end, the frame 234 had an inverted U-shape having a top web 213 on which the platform 233 is mounted and depending legs 214 and 215 integral therewith. An axle 220 is mounted horizontally across the legs 214 and 215 and is secured in place by conventional means. A pair of control wheels 218 and 219 are mounted in the frame 234 for combined rotary and axial motion on the axle 220 in the manner described heretofore. Each wheel, such as the right-hand wheel 219, has a tapered surface 219*a* and an outboard braking surface 219*b* adapted to engage one or more brake-pads 224 and 225 spaced radially outward from the axle 220. The left-hand wheel 218 is of like construction to the right-hand wheel 219 and has similar surfaces 218*a* and 218*b* which cooperate with similarly located brake-pads 221 and 222 mounted in the left-hand leg 215.

In order to urge the control wheels 218 and 219 outwardly into frictional engagement with their cooperating brake pads, an annular collar or ring 228 is mounted in the gap between the tapered confronting surfaces 218*a* and 219*a* of the control wheels 218 and 219, respectively. Preferably, the collar 218 somewhat loosely embraces the surfaces 218*a* and 219*a*, and preferably both the surfaces 218*a* and 219*a* and the collar 218 are roughened or serrated to frictionally engage one another to eliminate or at least minimize relative sliding motion therebetween. The clearance is indicated at C in FIG. 6.

For the purpose of displacing the collar 228 radially in the gap between the control wheels 218 and 219, and thereby forcing the control wheels into frictional engagement with the brake pads, a flexible member 217 is trained around a predetermined portion of the periphery of the collar 228. In this embodiment, the flexible member 217 includes a chain, preferably of the roller type, and preferably a series of sprocket teeth 228*a*, 228*b* are provided around the outer periphery of the collar 228 to engage the roller chain 217. A pair of guide sprockets 225' and 226' are rotatably mounted in the frame 234 in proximity with the periphery of the control wheels 218 and 219. The guide sprockets 225' and 226' are spaced apart vertically on the inside of the rotational axis of the wheels in the manner illustrated in FIG. 5 so that the roller chain 217 is trained around the sprockets and extends away from the rear of the frame 234 vertically alongside the driving chain 240. The upper run 217*a* of the roller chain 217 is connected at its upper end to the upper member 231 by means of a suitable fastener or anchor 260, and the lower run 217*b* of the roller chain is connected at its lower end to the base 230 by a suitable anchor 261. Although the flexible member 217 is illustrated as a roller chain, it should be apparent that a cable or other strong flexible member could be utilized, if desired.

In operation, vertical movement of the drive chain 240 causes the platform frame 234 to move upwardly or downwardly with the load on the platform 233 being carried by the drive chain 240 by virtue of its direct connection therewith. The auxiliary or helper chain 217 which is trained around the speed retarder 250 does not normally have any significant tension during normal operation of the unit 210. As a result, there is very little radially inwardly directed pressure on the collar 228, and this enables the control wheels 218 and 219 to slide relatively freely relative to the brake pads 221, 222, and 224, 225.

In the event the drive chain 240 should break, however, the load would be transferred immediately to the upper run 217*a* of the helper chain 217. Tension in the upper run 217*a* would cause pressure to be applied to the collar 228, which, in turn, would be forced into the gap between the control wheels 218 and 219 to urge the same outwardly into pressure engagement with the brake pads. This engagement of the collar 228 between the control wheels 218 and 219 causes friction to be applied between the brake pads and the outboard surfaces of the control wheels to retard the rotation of the control wheels 218 and 219. Because of the frictional engagement of the collar 228 with the control wheels 218 and 219, and the positive engagement of the collar 228 with the chain 217, braking of the control wheels 218 and 219 limits the speed with which the frame 234 and its load platform 233 descends. As a result, the platform 233 can be lowered safely and completely automatically at a controlled rate of speed in the event that the main drive chain 240 should break.

In the disclosed embodiment, both control wheels are mounted for combined rotary and axial movement on their supporting axle. It should be understood, however, that in applications where the full advantages of braking both wheels is not needed, only one of the wheels need be mounted for both rotary and axial motion. In such event it is preferable, but not absolutely necessary, for the tapered camming surface to be on the movable wheel.

In view of the foregoing, it should be apparent that the present invention provides a speed retarder which is simple in construction, which is reliable in operation, and which can be manufactured economically. While several applications for the speed retarder have been illustrated and described in detail, it should be apparent that many additional applications will readily come to mind. Thus, the invention should not be construed as being limited to fire escape and safety back-up applications.

While preferred embodiments of the present invention have been described in detail, various modifications, alterations, and changes may be made without departing from the spirit and scope of the present invention as defined in the appended claims.

We claim:

1. A speed retarder for use with a flexible member comprising:
   - a frame,
   - an axle mounted in said frame;
   - a pair of wheels rotatably mounted on said axle with at least one wheel of said pair also being axially movably mounted on said axle,
   - at least said one wheel having an outboard braking surface and a tapered inboard surface,
   - another wheel of said pair of wheels having an inboard surface confronting said tapered surface to define a peripheral gap therebetween,
   - brake pad means carried in said frame and operable upon outward sliding movement of said one wheel to slidably engage said one wheel with a continuous axially inward pressure operable to create between said one wheel and said frame friction acting counter to the rotational direction of said one wheel, with said pressure, and hence said friction, being directly related to the tension on the flexible member,
   - guide means carried by said frame for engaging said flexible member and maintaining the same engaged in said wheel gap through a predetermined arcuate extent,
   - whereby motion of the flexible member with tension thereon urges said one wheel outwardly to create said friction for retarding rotation of said wheels and thereby to retard the speed of the flexible member.

2. The speed retarder according to claim 1 wherein said brake pad means are mounted on said frame outboard of said wheels, and said other wheel is of like construction to said one wheel and both are mounted for combined rotary and axial outward motion on said axle into engagement with said outboard brake pad means.

3. The speed retarder according to claim 2 wherein said guide means includes a pair of guide rollers mounted in said frame in proximity with the periphery of said wheels to one side of said axle for causing the flexible member to pass between the guide rollers and the tapered wheel surfaces and through an arcuate extent of at least 180°.

4. The speed retarder according to claim 3 including means on said frame providing a hanger on the end of said frame opposite said guide wheels.

5. The speed retarder according to claim 3 including means fastening opposite ends of said flexible member at spaced locations so that said flexible member is disposed stationary, driving means movable longitudinally relative to said flexible member and connected to said frame so that said frame normally moves in unison with said driving means to provide a primary load moving function, and means carried by said frame for supporting a load, whereby failure of the driving means causes the load on the platform to be transferred to said stationary flexible member for causing said wheels to be urged outwardly against the brake pads for slowing the movement of the frame.

6. The speed retarder according to claim 3 wherein said flexible member includes a line, and said guide rollers have concave peripheries for guiding said line into the gap between the wheels.

7. The speed retarder according to claim 1 wherein said frame has a web and a pair of legs depending therefrom to define a U-shaped cross-section, means providing a hinged connection between one of said legs and said web, means defining opposed slots in said legs for slidably receiving said axle to permit the axle to be moved selectively toward and away from said web, and latching means on said axle and said one hinged leg cooperable normally to maintain said leg engaged with said axle and operable after said axle has been displaced toward said web to permit said hinged leg to be swung outwardly for exposing the wheels and enabling the flexible member to be installed in the gap between the wheels.

8. The speed retarder according to claim 7 wherein said latching means includes an enlargement in the slot in said hinged leg and an enlarged head on said axle sized to pass through said slot enlargement when aligned therewith but sized to prevent outward motion of the hinged leg when the axle is slid away from the web toward its normal operating position.

9. The speed retarder according to claim 1 wherein said guide means includes a collar disposed in said gap between said wheels, said collar having opposite end surfaces engaging the inboard surfaces of said wheels and being dimensioned axially between said end surfaces to provide a peripheral surface engageable by said flexible member, said collar surrounding said axle and adapted, when tension is applied to the flexible member, to urge said one wheel outward to effect the desired speed retarding function.

10. The speed retarder according to claim 9 wherein said other wheel is of like construction to said one wheel and both are mounted for combined rotary and axial movement on said axle, and wherein said brake pad means includes brake pads located outboard of both wheels in said frame.

11. The speed retarder according to claim 10 wherein said flexible member includes a line wrapped at least one complete turn around said collar.

12. The speed retarder according to claim 11 wherein said collar is dimensioned between its end surfaces to receive a plurality of complete wraps of said line.

13. The speed retarder according to claim 9 wherein said collar is fabricated of compressible material adapted, when compressed circumferentially by the flexible member, to expand axially against the inboard surfaces of said wheels.

14. The speed retarder according to claim 9 wherein said collar is fabricated of rigid material and is mounted in said gap between said wheels with a slight clearance therebetween.

15. The speed retarder according to claim 9 wherein said flexible member includes a chain, and including means on the periphery of said collar engaging said chain to limit relative motion therebetween.

16. The speed retarder according to claim 15 wherein said chain is of the roller type and said motion limiting means on said collar includes a teeth engaging said roller chain.

17. The speed retarder according to claim 16 wherein said guide means further includes a pair of sprockets mounted in said frame in proximity with said wheels and with one another for causing said chain to engage said teeth around a substantial portion of the periphery of said collar, means fastening opposite ends of said chain at spaced locations to mount said chain stationary, a drive chain extending along side said first chain and movable in a longitudinal path, means connecing said frame to said drive chain so that frame moves in unison therewith to provide a primary load moving function, and means carried by said frame for supporting a load, whereby breakage of the drive chain causes the load thereon to be transferred to said stationary load-carrying chain for causing said one wheel to be urged outwardly against the brake pad for slowing the movement of the frame between said spaced locations.

18. A fail-safe elevator comprising:

an upright structure having spaced members providing upper and lower levels, a platform movable vertically between said levels, a first member connected to said platform and movable longitudinally between said levels to provide a primary means for raising and lowering the platform, a second elongated flexible member extending stationary between said levels, a braking assembly carried by said platform for cooperating with said stationary flexible member to control the rate of descent of the platform in the event of failure of said first flexible member, said braking assembly including:

a frame, an axle mounted in said frame, a pair of wheels rotatably mounted on said axle with at least one wheel of said pair also being slidable axially on said axle, at least said one wheel having an outboard braking surface and a tapered inboard surface, another wheel of said pair of wheels having a surface confronting said tapered surface to define a peripheral gap therebetween, brake pad means carried by said frame and operable upon outward sliding motion of said one wheel to create friction between said one wheel and said frame, guide means on said frame for engaging said flexible member and maintaining the same engaged in said gap through a predetermined arcuate extent, whereby failure of the first member causes the load on the platform to be transferred to the second flexible member whereupon said one wheel is urged outwardly to create friction for retarding the downward speed of the platform.

19. The fail-safe elevator according to claim 18 wherein said brake pad means includes brake pads located in said frame outboard of said wheels, and wherein said other wheel of said pair is of like construction to said one wheel and both are mounted for combined rotary and axial outward motion on said axle into engagement with said outboard brake pads.

20. The fail-safe elevator according to claim 19 wherein said guide means includes a pair of rollers mounted adjacent to the periphery of said wheels with one roller being disposed at a level higher than the other roller and both rollers being disposed to one side of said axle for causing said stationary second flexible member to pass between said rollers and around the periphery of the wheels through said arcuate extent.

21. The fail-safe elevator according to claim 20 wherein said guide means also includes a collar disposed in said gap between said wheels and movable radially in response to pressure applied thereto by said flexible member to apply said braking action.

22. The fail-safe elevator according to claim 21 wherein said flexible member includes a chain and said collar includes teeth engaging said chain to limit relative motion between said chain and said collar, said collar being mounted in said gap with a slight clearance for applying said axially outward pressure to said one wheel.

* * * * *